US007055872B2

(12) United States Patent
Hayakawa et al.

(10) Patent No.: US 7,055,872 B2
(45) Date of Patent: Jun. 6, 2006

(54) DOOR LOCK DEVICE

(75) Inventors: Shigeru Hayakawa, Chiryu (JP); Ryujiro Akizuki, Kariya (JP); Kan Ichihara, Kariya (JP); Norio Konomoto, Nagoya (JP); Akira Muramatsu, Chiryu (JP); Takeshi Yasuda, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/628,448

(22) Filed: Jul. 29, 2003

(65) Prior Publication Data

US 2004/0119296 A1 Jun. 24, 2004

(30) Foreign Application Priority Data

Jul. 29, 2002 (JP) ..... 2002-219863

(51) Int. Cl.
*E05C 3/06* (2006.01)
*E05C 3/16* (2006.01)

(52) U.S. Cl. ..... 292/216; 292/201; 292/DIG. 23

(58) Field of Classification Search ..... 292/216, 292/201, DIG. 23
See application file for complete search history.

(56) References Cited

U.S. PATENT DOCUMENTS

| | | | | | |
|---|---|---|---|---|---|
| 6,053,543 | A | * | 4/2000 | Arabia et al. | 292/201 |
| 6,435,573 | B1 | * | 8/2002 | Szablewski | 292/201 |
| 6,511,106 | B1 | * | 1/2003 | Perkins et al. | 292/216 |
| 6,592,157 | B1 | * | 7/2003 | Spurr | 292/216 |
| 6,607,222 | B1 | * | 8/2003 | Inoue | 292/216 |
| 6,733,052 | B1 | * | 5/2004 | Perkins et al. | 292/201 |

FOREIGN PATENT DOCUMENTS

JP 11-166337 A 6/1999

* cited by examiner

*Primary Examiner*—John B. Walsh
(74) *Attorney, Agent, or Firm*—Buchanan Ingersoll PC

(57) ABSTRACT

A door lock device includes a latch mechanism, a lift lever, an open lever, a lock lever, an open member including a link member having an operation input portion connected to the open lever and an acting portion engageable with the lift lever, and an elastic member connecting the link member and the lock lever. When the open member is in the unlocked position, the open member engages with the lift lever by an operation of the open lever in one direction thereby allowing an operation of the lift lever. When the open member is in the locked position, the open member idly engages with the lift lever by the operation of the open lever and then becomes engaged with the lift lever in the other direction thereby prohibiting the operation of the lift lever when the open member is switched to the unlocked position from the locked position.

14 Claims, 11 Drawing Sheets

DOOR LOCK DEVICE

This application is based on and claims priority under 35 U.S.C. § 119 with respect to Japanese Application No. 2002-219863 filed on Jul. 29, 2002, the entire content of which is incorporated herein by reference.

FIELD OF THE INVENTION

This invention generally relates to a door lock device.

BACKGROUND OF THE INVENTION

A known door lock device includes a latch mechanism provided at a vehicle door and engageable with or disengageable from a striker provided at a vehicle-body, a lift lever for operating the latch mechanism from an engaged state to a disengaged state by engaging with or disengaging from the striker, an open lever operated by an operation of a door opening member provided at the vehicle door, and a lock lever movable between an unlocked position and a locked position by an operation of a door locking/unlocking member provided at the vehicle door. The known door lock device further includes an open member operated with the lock lever and movable between the unlocked position and the locked position. When the open member is in the unlocked position, the open member engages with the lift lever by the operation of the open lever in one direction, thereby allowing the operation of the lift lever. When the open member is in the locked position, the open member idly engages with the lift lever by the operation of the open lever and then becomes engaged with the lift lever in the other direction when the open member is switched to the unlocked position from the locked position, thereby prohibiting the operation of the lift lever.

According to the known device, an unlocked state is defined when the open member is in the unlocked position while a locked state is defined when the open member is in the locked position. In the unlocked state, the open member is operated with the lift lever by engaging therewith due to the operation of a door handle and the like whereby the latch mechanism disengages from the striker. In the locked state, the open member idly engages with the lift lever and thus the lift lever is not operated even if the door handle is operated. The latch mechanism cannot disengage from the striker accordingly.

When the door handle and the door locking/unlocking member such as a door lock knob are operated at substantially the same time in the locked state, the aforementioned device is known to cause a problem as follows. When the door handle is operated before the operation of the door lock knob, the open member is moved to a full-stroke position under the locked state relative to the lift lever and then moved toward the unlocked position. In this case, the open member engages with the lift lever in the other direction and thus both the lift lever and the open member cannot be moved to the unlocked position. Thus, when the door handle is returned to a normal position from a pulled position, the door lock knob remains in the locked position even though the door lock knob is once operated to be unlocked (which is called a panic state). It is required to operate the door lock knob again to switch to the unlocked state, which causes the bother of operation. This kind of bother may occur in a door lock system for automatically switching to the unlocked state from the locked state by detecting an approach of the user's hand to the door handle. In this case, the door handle can be operated before the automatic switching to the unlocked state depending on the control timing.

A device disclosed in Japanese Patent Laid-Open Publication No. 11-166337 is known to solve the above-mentioned problem. FIG. 11 shows a structure of the disclosed device. The disclosed device includes a lift lever 90 for operating the latch mechanism from the engaged state to the disengaged state by engaging with or disengaging from the striker provided at the vehicle body, an open lever 91 operated by the operation of the door handle provided at the vehicle door, and a lock lever 92 provided at the vehicle door and operated by the operation of the door lock knob and the like. The disclosed device further includes an open member 93 operated with the lock lever 92 and movable between the unlocked position and the locked position.

The open member 93 engages with the lift lever 90 in S direction, thereby allowing the operation of the lift lever 90 when the open member 93 is in the unlocked position. The open member 93 also idly engages with the lift lever 90 in the locked position. The open member 93 includes a main link 94 connected to the open lever 91 and the lock lever 92, and a sub link 95 mounted on the main link 94 via a shaft 97 so that the sub link 95 rotates relative to the main link 94 and engageable with the lift lever 90. The open member 93 further includes a spring 96 disposed between the main link 94 and the sub link 95. FIG. 11 shows the locked state in which the open member 93 is in the locked position.

The aforementioned disclosed device is operated as follows in the locked state when the door handle and the door lock knob are operated substantially at the same time. The open member 93 is moved in substantially S direction in FIG. 11 while idly engaging with the lift lever 90 by the operation of the door handle and the like. Then, the open member 93 is moved in T direction, i.e. unlocked position, by the operation of the door lock knob and the like. In this case, the sub link 95 engages with the lift lever 90 in T direction and at the same time, rotates relative to the main link 94. The main link 94 of the open member 93 is therefore moved to the unlocked position together with the lock lever 92. When the door handle is returned to the normal position, the sub link 95 rotates relative to the main link 94 by a biasing force of the spring 96. Then, the open member 93 as a whole is returned to the unlocked initial position (i.e. recovered from the panic state). It is thus not required to operate the door lock knob again.

According to the above mentioned device, however, the sub link 95 is provided so as to rotate relative to the main link 94, and then the spring 96 is disposed between the main link 94 and the sub link 95. The structure of the device is thus complicated, which may be disadvantageous for the assembly condition of the device.

Thus, a need exists for a door lock device which can reduce the bother of operation without a complicated structure.

SUMMARY OF THE INVENTION

According to an aspect of the present invention, a door lock device includes a latch mechanism provided at a vehicle door and engageable with or disengageable from a striker provided at a vehicle-body, a lift lever for operating the latch mechanism from an engaged state in which the latch mechanism engages with the striker to a disengaged state in which the latch mechanism disengages from the striker, an open lever operated by an operation of a door opening mechanism provided at the vehicle door, and a lock lever movable between an unlocked position and a locked position by an operation of a door locking/unlocking member provided at the vehicle door.

The door lock device also includes an open member operated with the lock lever and movable between an unlocked position and a locked position. The open member includes a link member having an operation input portion receiving an operation force from the open lever and an acting portion engageable with the lift lever, and an elastic member connecting the link member and the lock lever. When the open member is in the unlocked position, the open member engages with the lift lever by an operation of the open lever in one direction thereby allowing an operation of the lift lever. In addition, when the open member is in the locked position, the open member idly engages with the lift lever by the operation of the open lever and then becomes engaged with the lift lever in the other direction thereby prohibiting the operation of the lift lever when the open member is switched to the unlocked position from the locked position.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

A first embodiment of the present invention is explained referring to attached drawings. In each drawing, a vehicle frontward direction, a vehicle inner direction, and a vehicle upward direction are represented by F, I, and U respectively using arrows.

Figure 1:
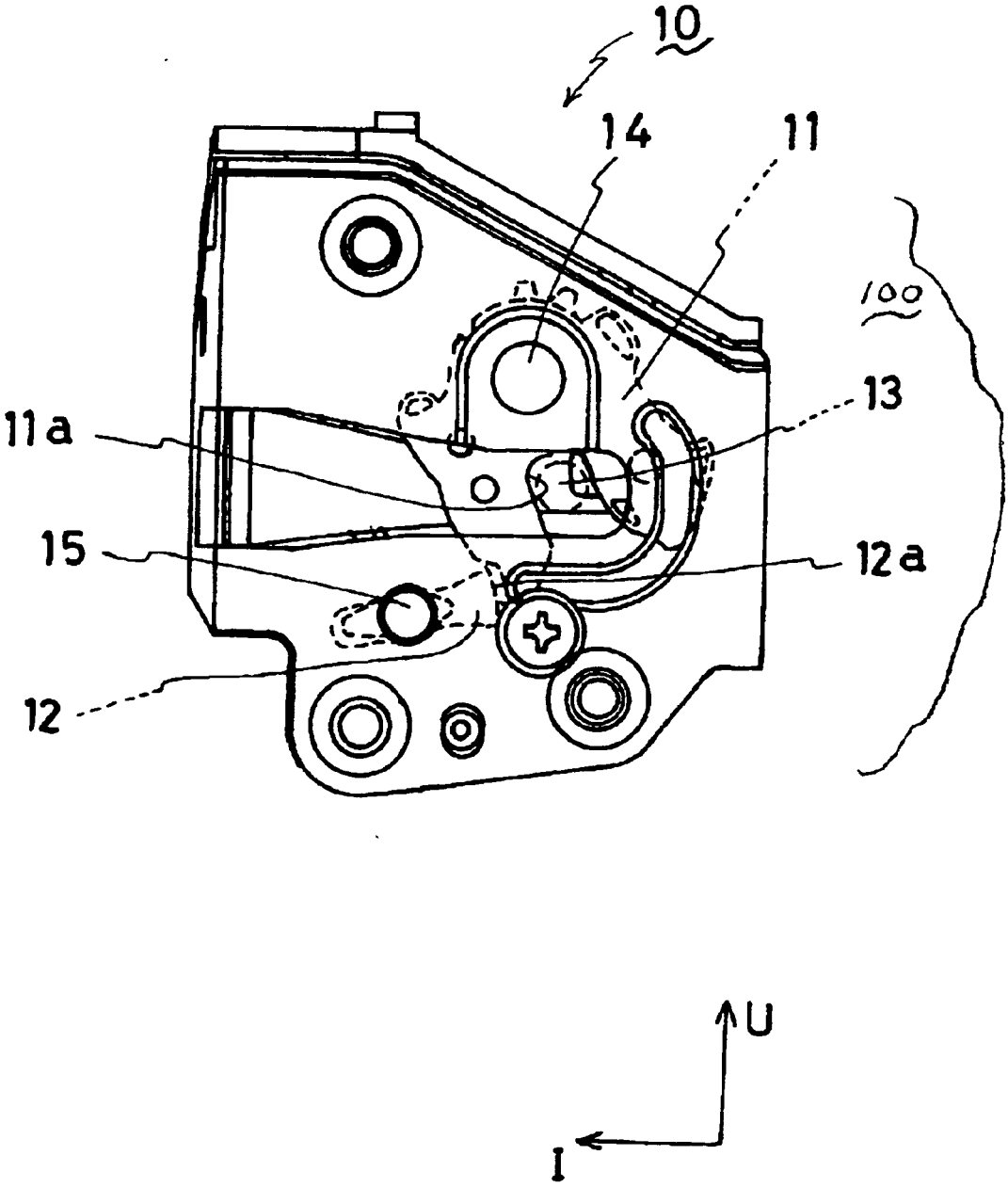
FIG. 1 is a plain view of a latch mechanism of a door lock device according to a first embodiment of the present invention.

A latch mechanism of a door lock device 10 is first explained referring to FIG. 1. The door lock device 10 is provided at a vehicle door (generally depicted at 100 in FIG. 1) and including a latch 11 (latch mechanism) and a pawl 12 (latch mechanism). The latch 11 includes a receiving groove 11*a* for receiving and capturing a striker 13 therein provided at a vehicle body (not shown). The pawl 12 includes a contacting portion 12*a* in contact with the latch 11, restricting a rotation of the latch 11. The latch 11 and the pawl 12 are connected to shafts 14 and 15 of the door lock device 10 respectively, being rotatable as a unit with the shafts 14 and 15 respectively.

An operation of the latch mechanism of the door lock device 10 is explained as follows. FIG. 1 shows a latched state in which the latch 11 captures the striker 13. In the latched state, the vehicle door is held at the vehicle body, i.e. door closing hold sate. When the latch 11 rotates in a clockwise direction in FIG. 1 with a predetermined amount from the latched state, the striker 13 becomes disengageable in a leftward direction in FIG. 1, which is an unlatched state. The vehicle door can be thus opened relative to the vehicle body. The latch 11 is biased in the clockwise direction in FIG. 1 by a spring (not shown) arranged around the shaft 14. The latch 11 rotates depending on a biasing force of the spring. The pawl 12 restricts the rotation of the latch 11 via the contacting portion 12*a* in the latched state as mentioned above. When the pawl 12 rotates in the clockwise direction in FIG. 1 with a predetermined amount the contacting portion 12*a* disengages from the latch 11 whereby the latch 11 rotates to a point where the latch 11 is in the unlatched state. The latch 11 can be operated by the pawl 12 to engage with or disengage from the latch 11. The pawl 12 is also biased in a counterclockwise direction in FIG. 1 by a spring (not shown) arranged around the shaft 15. As mentioned above, the latch 11 engages with or disengages from the striker 13 accordingly.

Figure 2:
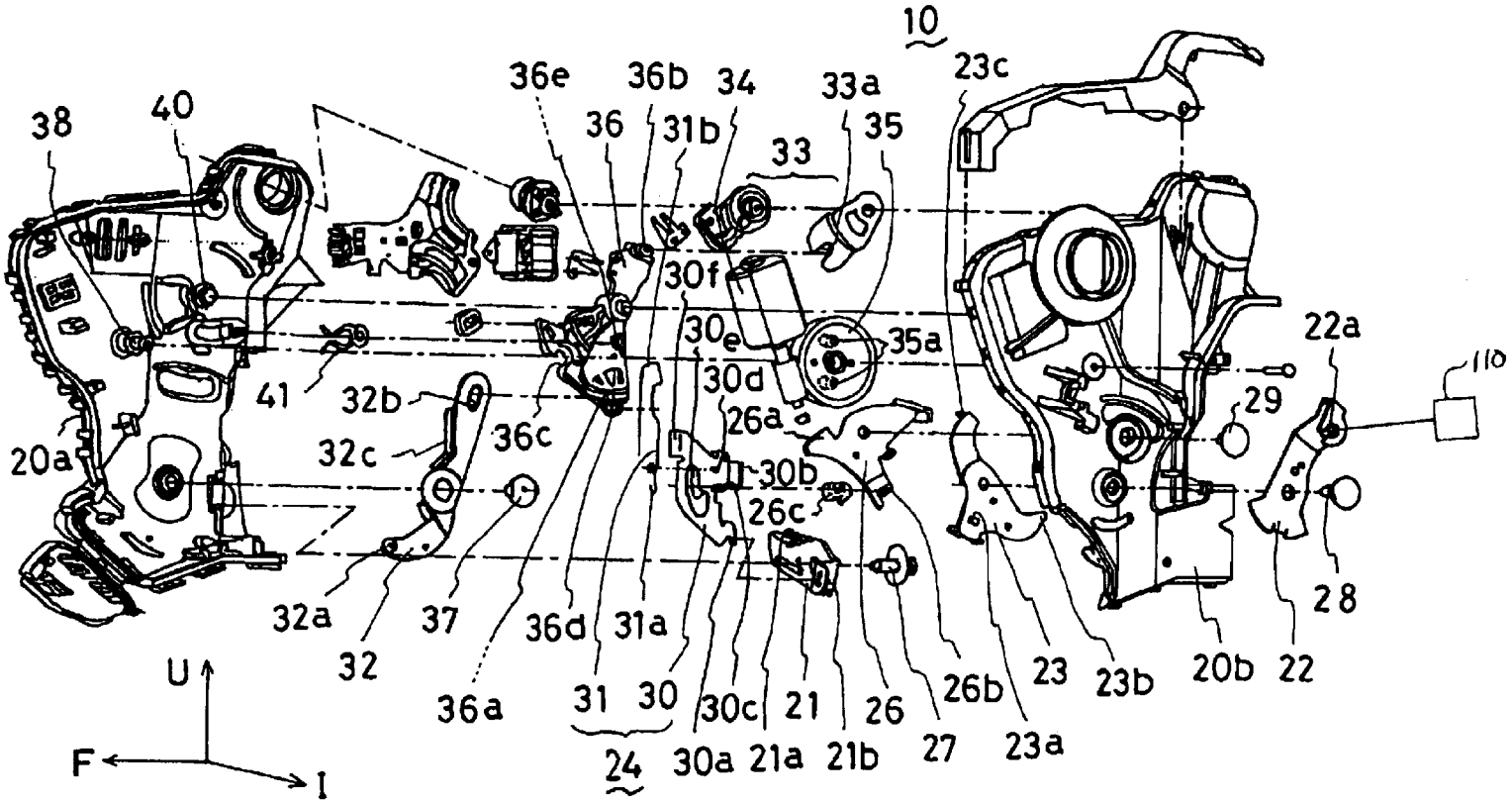
FIG. 2 is an exploded perspective view of a lock mechanism of the door lock device according to the first embodiment of the present invention.
Figure 3:
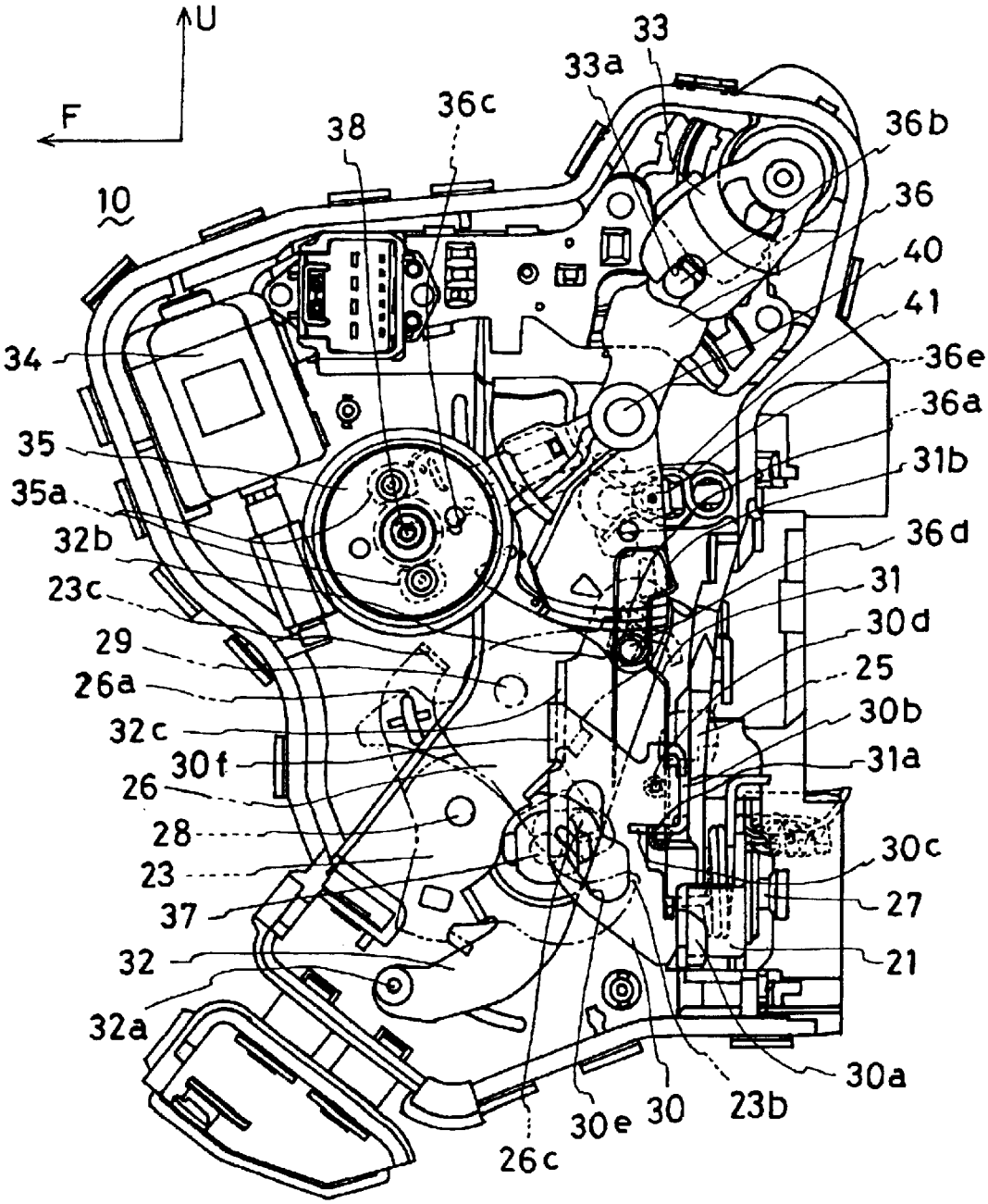
FIG. 3 is a plane view of the lock mechanism of the door lock device according to the first embodiment of the present invention.

A lock mechanism of the door lock device 10 is explained with reference to FIGS. 2 and 3. As shown in FIG. 2, the door lock device 10 includes a pair of cases 20*a* and 20*b* constituting a housing where each member is accommodated. FIG. 2 is an exploded perspective view of the lock mechanism of the door lock device 10. FIG. 3 is a plane view showing a state in which main members are accommodated in the case 20*a*.

The lock mechanism of the door lock device 10 substantially includes an opening operation member and a locking operation member. The opening operation member actuates the latch 11 to open the door relative to the vehicle body in response to an operation of an outside handle (door opening member) (not shown) provided at the outer side of the vehicle door or an inside handle (door opening member) (not shown) provided at the inner side of the vehicle door. The locking operation member switches an unlocked state in which the latch 11 can be operated and a locked state in which the latch 11 cannot be operated therebetween by the operation of the outside handle and the like.

The opening operation member includes an outside open lever 21 (open lever), a first inside open lever 22 (open lever), a second inside open lever 23 (open lever), an open member 24 (open member), a lift lever 25 (lift lever) (shown by chain double-dashed line in FIG. 3) and a cancel lever 26.

The outside open lever 21 is rotatably connected to a shaft 27 extending in the longitudinal direction of the vehicle. One end of the outside open lever 21 is formed with a connecting hole 21*a* to which the outside handle is connected via a rod and the like (not shown). The other end of the outside open lever 21 is formed with a connecting hole 21*b* having a substantially figure-eight shape. The outside open lever 21 rotates with respect to the shaft 27 when the outside handle is operated.

The first inside open lever 22 is rotatably secured to the vehicle inner side of the case 20*b* via a pin 28. One end of the first inside open lever 22 is formed with a connecting notch 22*a* to which the inside handle (schematically depicted at 110 in FIG. 2) is connected via a rod (not shown) and the like. The other end of the first inside open lever 22 is formed with a flange extending into an arc hole 20*c* formed at the case 20*b*. The first inside open lever 22 rotates with respect to the pin 28 when the inside handle is operated.

The second inside open lever 23 is rotatably secured to the vehicle outer side of the case 20*b* via the pin 28. The second inside open lever 23 includes a connecting hole 23*a* with which the flange of the first inside open lever 22 engages. The torque is transmitted from the first inside open lever 22 to the second inside open lever 23 via the portion where the connecting hole 23*a* of the second inside open lever 23 and the flange of the first inside open lever 22 enrage with each other. The first and second inside open levers 22 and 23 rotate as a unit accordingly. The second inside open lever 23 further includes a projecting portion 23*b* and a flange 23*c*.

The open member 24 includes an open link 30 (link member) and a spring 31 (elastic member). The open link 30 made of rigid metallic sheet includes a connecting portion 30*a* (operation force input portion), a flange 30*b* (acting portion) formed to face to the case 20*b* and extending in the vertical direction (up and down direction of the vehicle), a flange 30*c* (operation force input portion) bent from the flange 30*b* so as to be substantially perpendicular thereto, an engaging pin 30*d*, a hole 30*e*, and a flange 30*f* formed to face to the case 20*a*. The connecting portion 30*a* is connected to the connecting hole 21*b* of the outside open lever 21. The torque is transmitted to the open link 30 from the outside open lever 21 via the portion where the connecting portion 30*a* and the connecting hole 21*b* are open link 30 is operated at the same time to be moved upward and downward directions of the vehicle.

The flange 30*b* is arranged adjacent to the lift lever 25 as shown in FIG. 3. The lift lever 25 is connected to the shaft 15, to which the pawl 12 is connected, so as to be rotatable as a unit with the shaft 15. When the lift lever 25 is moved upward in FIG. 3, the pawl 12 rotates in the clockwise direction in FIG. 1.

When the second inside open lever 23 rotates in the counterclockwise direction in FIG. 3, the projecting portion 23*b* becomes engaged with the flange 30*c*. That is, the torque is input to the flange 30*c* from the second inside open lever 23 due to the engagement between the projecting portion 23*b* and the flange 30*c* when the second inside open lever 23 rotates. The open link 30 is then moved upward in FIG. 3.

One end 31*a* of the spring 31 is engaged with the open link 30. The spring 31 is wound around the engaging pin 30*d*. A U-shaped portion 31*b* of the spring 31 extending in the upward direction of the vehicle is flexible so as to pivotally move with respect to the vicinity of the engaging pin 30*d*.

The cancel lever 26 is rotatably secured to the case 20*b* via a pin 29. The cancel lever 26 includes a projecting portion 26*a* and a flange 26*b*. When the second inside open lever 23 rotates in the counterclockwise direction in FIG. 3, the flange 23*c* becomes engaged with the projecting portion 26*a*. The second inside open lever 23 and the cancel lever 26 are therefore operated together after the flange 23*c* and the projecting portion 26*a* engage with each other. In addition, a boss 26*c* is provided at the flange 26*b* and connected to the hole 30*e* of the open link 30.

The locking operation member of the door lock device 10 includes an inside locking lever 32 (transmission member), a key lever 33, a motor 34, a wheel gear 35, an active lever 36 (lock lever) and the like. The inside locking lever 32 is rotatably secured to the vehicle inner side of the case 20*a* via a pin 37. A connecting hole 32*a* formed at one end of the inside locking lever 32 is connected to the door lock knob (not shown) provided at the vehicle inner side of the door via a cable (not shown) and the like. The inside locking lever 32 rotates with respect to the pin 37 by the operation of the door lock knob. A connecting elongated hole 32*b* is formed at the other end of the inside locking lever 32. Further, a bending flange 32*c* extending toward the case 20*b* is formed between the pin 37 and the other end of the inside locking lever 32. The bending flange 32*c* and the flange 30*f* of the open link 30 are engageable with each other due to the relative position thereof.

The key lever 33 is connected do the key cylinder (not shown) provided at the vehicle outer side of the door via a rod (not shown) and the like. The key lever 33 rotates when the key cylinder is operated by a key. The key lever 33 includes a connecting notch 33*a*.

The motor 34 is actuated by ECU (not shown) provided in the door or in the vehicle body. The ECU transmits an operation signal to the motor 34 by receiving a signal from the door lock switch (not shown) provided at the vehicle inner side of the door. The ECU also transmits the operation signal to the motor 34 by receiving a signal from the electric capacitance sensor provided at the outside handle in case that the approach of the user's hand is detected. The wheel gear 35 is rotatably provided at the case 20*a* via a shaft 38 and rotates in response to the driving of the motor 34. The wheel gear 35 includes a pair of connecting pins 35*a*. The ECU may transmit the operation signal to the motor 34 by receiving a switch signal from a pressing-type switch, instead of the electric capacitance sensor, provided at the outside handle.

The active lever 36 having a substantially fan shape is rotatably provided at the case 20*a* via a shaft 40. The active lever 36 includes a connecting pin 36*a* and a control pin 36*e* extending toward the case 20*a* from the active lever 36. The active lever 36 also includes a connecting pins 36*b*, 36*d* extending toward the case 20*b* from the active lever 36, and a connecting concave portion 36*c*. The connecting pin 36*a* is connected to the connecting elongated hole 32*b* of the inside locking lever 32. The connecting pin 36*b* is connected to the connecting notch 33*a* of the key lever 33. The pair of connecting pins 35*a* are engageable with and disengageable from the connecting concave portion 36*c* depending on the rotation of the wheel gear 35. According to the above structure, the active lever 36 rotates with respect to the shaft 40 due to the operation of the inside locking lever 32, the key lever 33, and the motor 34. When the active lever 36 rotates, the control pin 36*e* is moved within a space defined by a control spring 41 secured to the case 20*a*. According to a shape of the control spring 41 for holding the control pin 36*e* and a structure of the control pin 36*e*, a moderate rotational behavior of the active lever 36 can be obtained. In addition, the connecting pin 36*d* of the active lever 36 is positioned within a space defined by the U-shaped portion 31*b* of the spring 31. Therefore, the open member 24 as a whole (spring 31 and open link 30) is operated (i.e., rotates with respect to the connecting portion 30*a*) in accordance with the rotation of the active lever 36.

Figure 4:
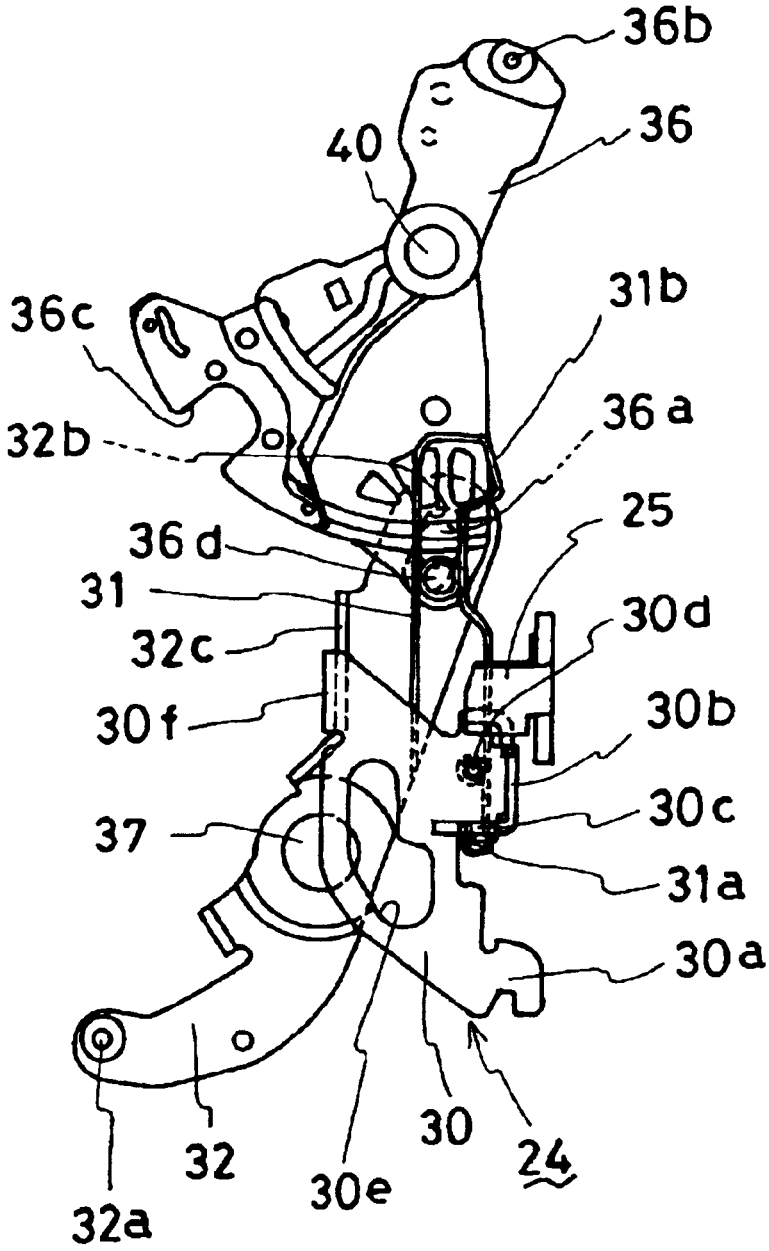
FIG. 4 is a plane view showing an unlocked state of the door lock device according to the first embodiment of the present invention.
Figure 5:
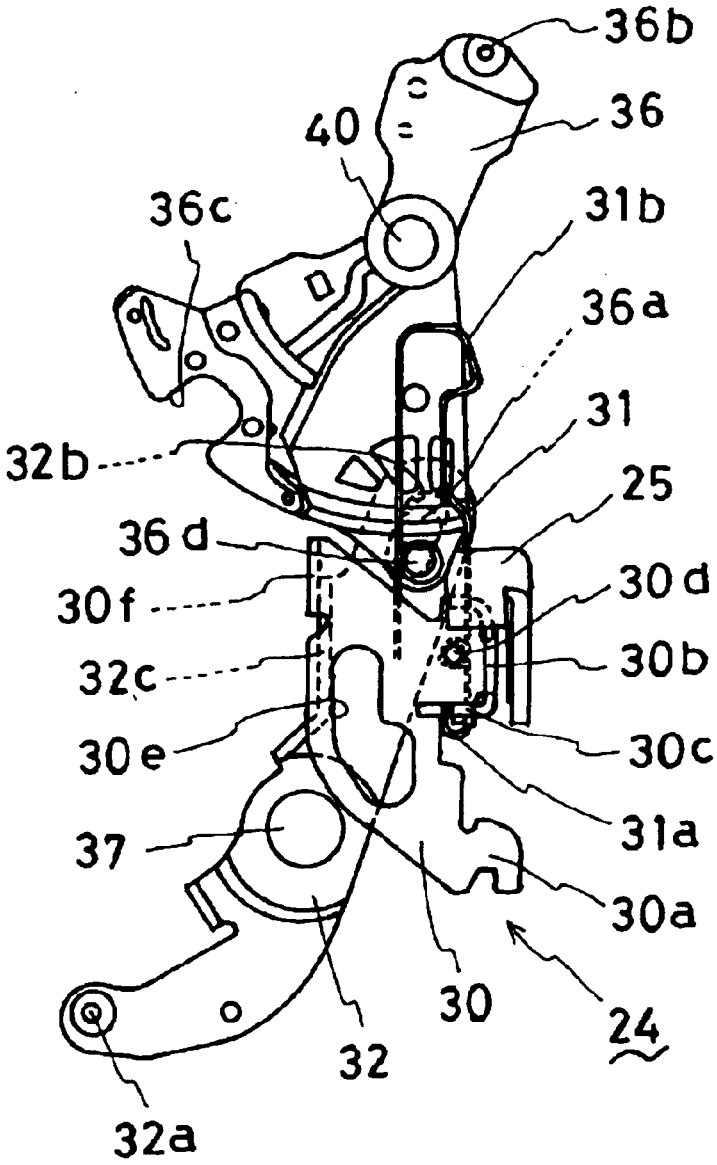
FIG. 5 is a plane view showing a state in which a door handle is operated in the unlocked state of the door lock device according to the first embodiment of the present invention.

An operation of the door lock device 10 is explained referring to FIGS. 4–10. FIG. 4 shows the unlocked state of the door lock device 10. In the unlocked state, the flange 30*b* of the open link 30 is provided below the lift lever 25. That is, the flange 30*b* is in the unlocked position. The active lever 36 is also in the unlocked position. When the door is operated to open due to the operation of the outside door handle and the like in this state, the open member 24 as a whole is moved upward in FIG. 4 via the outside open lever 21 and the like. The flange 30*b* of the open link 30 becomes engaged with the lift lever 25 in the vehicle upward direction (i.e. one direction). The lift lever 25 is movable upward and thus the pawl 12 and the latch 11 are operated (i.e. in the unlatched state) as shown in FIG. 5. When the open member 24 is moved, the connecting pin 36*d* of the active lever 36 is relatively moved within the U-shaped portion 31*b* of the spring 31.

Figure 6:
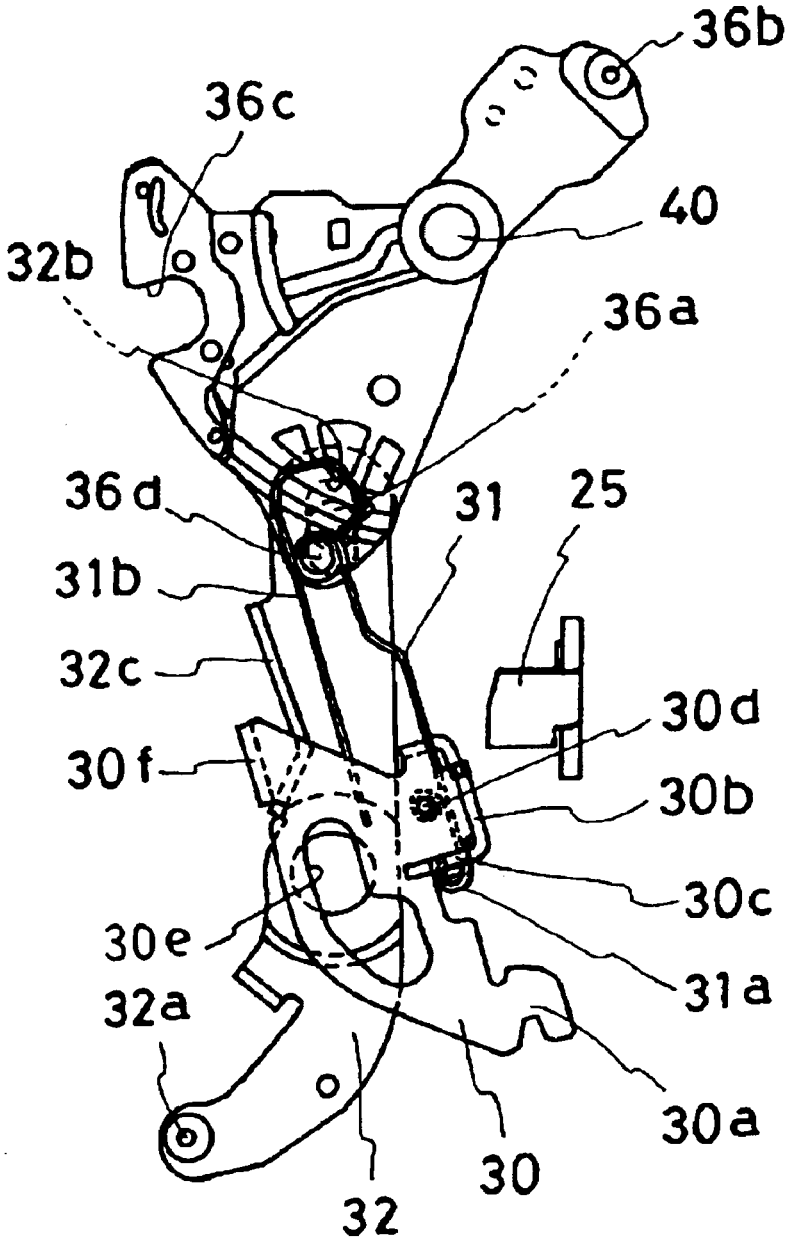
FIG. 6 is a plane view showing a locked state of the door lock device according to the first embodiment of the present invention.

In case that the locked operation (switching to the locked state) is performed in the unlocked state shown in FIG. 4 due to the activation of the motor 34 for example, a rotation force from the motor 34 is applied to the active lever 36 via the wheel gear 35, thereby rotating the active lever 36 in the clockwise direction in FIG. 4 with respect to the shaft 40. At this time, a rotation force of the active lever 36 is transmitted to the spring 31 via the connecting pin 36*d*. As a result, the open member 24 as a whole rotates in the counterclockwise direction in FIG. 4 with a predetermined amount with respect to the connecting portion 30*a* as shown in FIG. 6. In FIG. 6, the active lever 36 and the open member 24 are each in the unlocked state as placed in the unlocked position.

Figure 7:
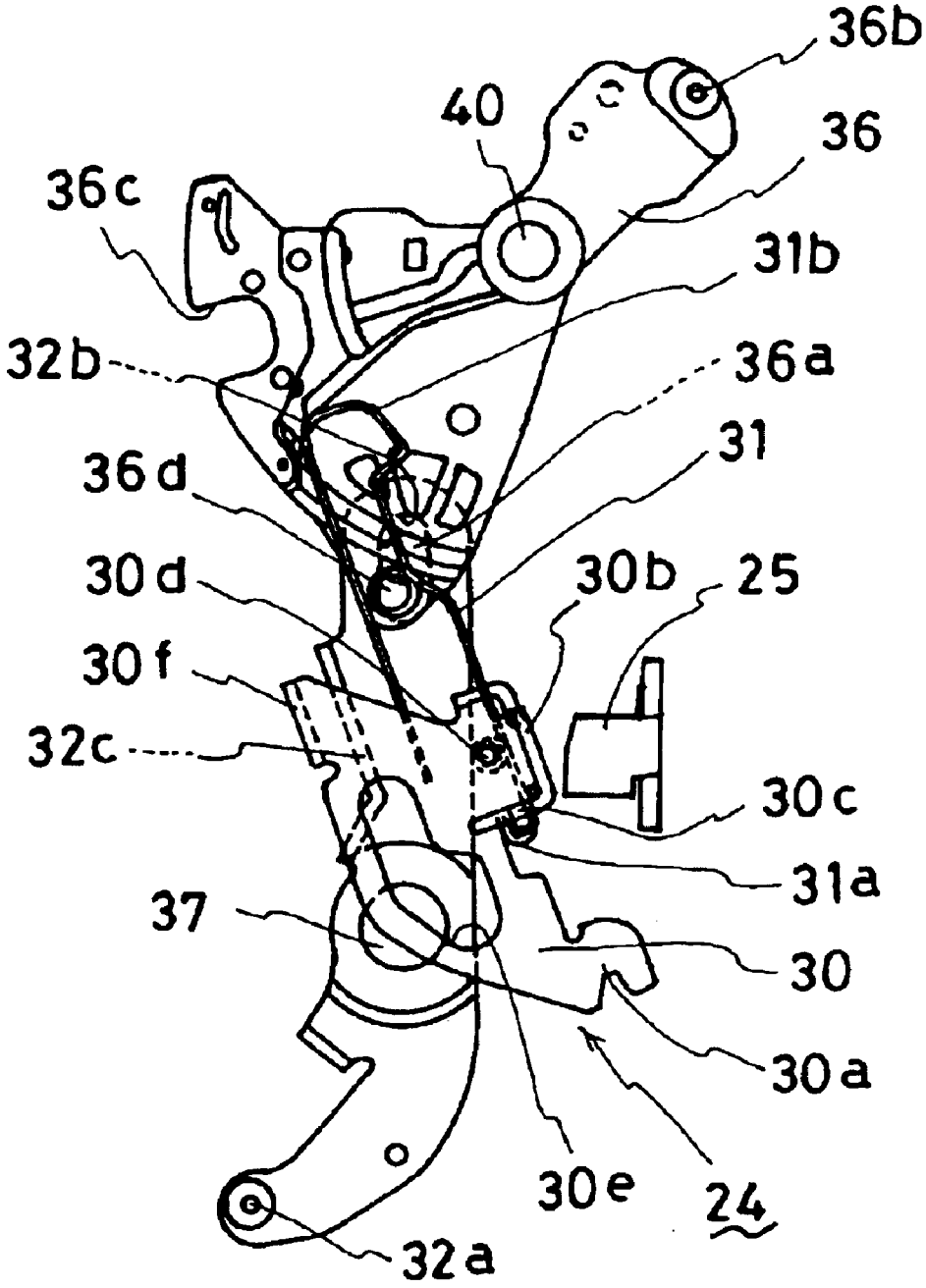
FIG. 7 is a plane view showing a state in which the door handle is operated in the locked state of the door lock device according to the first embodiment of the present invention.

When the outside handle is operated in the locked state (door is operated to open), the open member 24 as a whole is moved in substantially upward direction in FIG. 6. At this time, the flange 30*b* idly engages with the lift lever 25, which results in a disengagement between the open link 30 and the lift lever 25 as shown in FIG. 7. Thus, when the vehicle door is operated to open in the locked state, the vehicle door is not brought to the unlatched state since the lift lever 25 cannot be operated.

Figure 8:
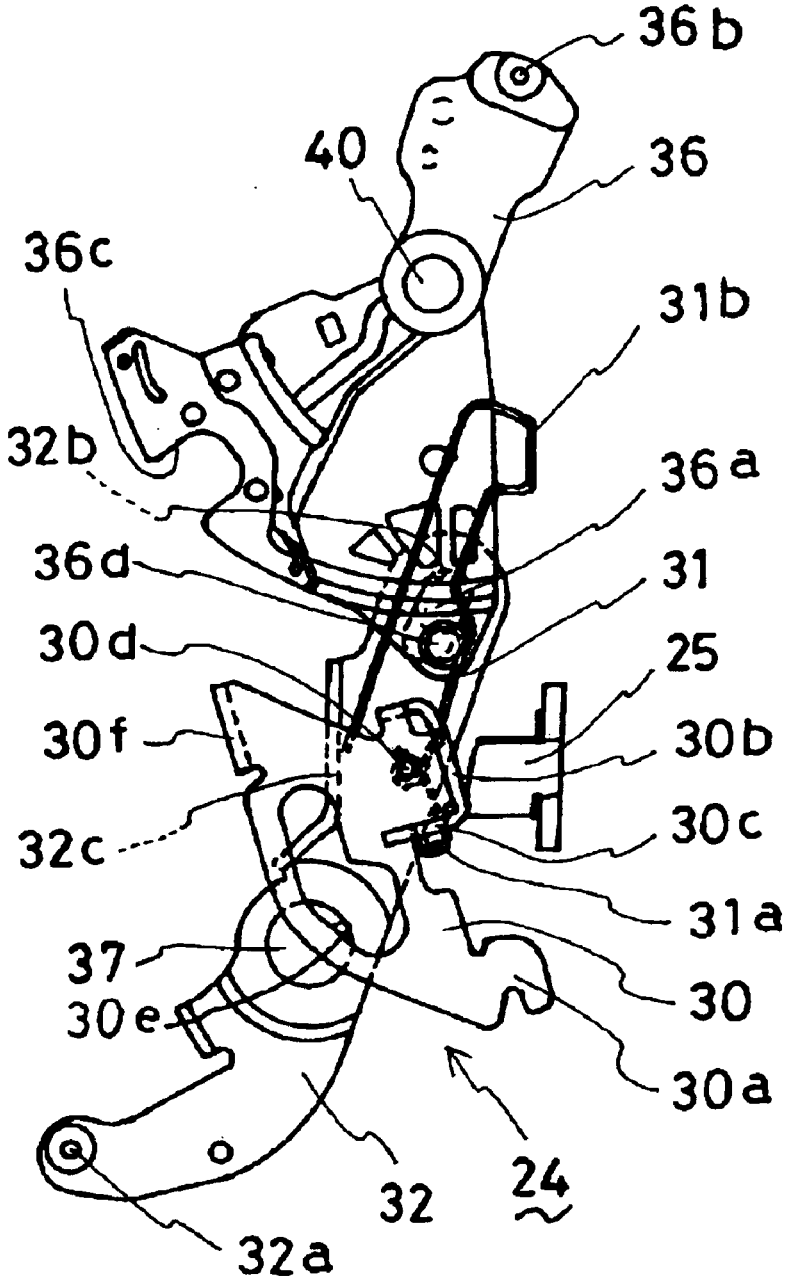
FIG. 8 is a plane view showing a state in which an unlock operation is performed from the state of FIG. 7.

In case that the unlocked operation (switching to the unlocked state) is performed in the state shown in FIG. 7 via the activation of the motor 34 for example, the active lever 36 rotates in the counterclockwise direction in FIG. 7 with a predetermined amount with respect to the shaft 40. At this time, a rotation force of the active lever 36 is transmitted to the spring 31 via the connecting pin 36*d*. Then, the flange 30*b* engages with the lift lever 25 in the rightward direction in FIG. 7 (i.e. other direction), thereby prohibiting the lift lever 25 from operating. The open link 30 is thus restricted to move. In this case, however, the spring 31 is flexibly moved with respect to the vicinity of the engaging pin 30*d*, thereby shifting the active lever 36 to the unlocked position. According to the present embodiment, a torque of the control spring 41 is set smaller than that of the spring 31 so that the active lever 36 can be moved to the unlocked position as shown in FIG. 8. In case that the outside handle is returned to the normal position (i.e. open operation is cancelled) from a state shown in FIG. 8, the open member 24 is moved downward in FIG. 8 whereby the engagement between the flange 30*b* and the lift lever 25 is released. The open link 30 rotates with a predetermined amount with respect to the connecting portion 30*a* due to a biasing force of the spring 31. Then, the unlocked state of the door lock device 10 as shown in FIG. 4 can be obtained.

As explained above, when the door opening member and the door locking/unlocking member are performed at substantially the same time in the locked state, the open member idly engages with the lift lever due to the operation of the door opening member in case that the door opening member is operated before the operation of the door locking/unlocking member. Then, when the door locking/unlocking member is operated in this state, the open member is operated together with the lock lever and becomes engaged with the lift lever in other direction. At this time, the engagement is obtained between the acting portion of the link member and the lift lever. Since the elastic member is disposed between the lock lever and the link member, the lock lever is moved to the unlocked position due to the flexible movement of the elastic member. That is, the lock lever can be moved to the unlocked position regardless of the engagement between the link member and the lift lever. When the operation of the door opening member is returned in this state, the engagement between the link member and the lift lever is released. The open member as a whole is moved to the unlocked position since the elastic member is returned by the biasing force thereof. Thus, the door lock device is switched from the locked state to the unlocked state.

Accordingly, even when the operation of the outside handle and the like and the actuation of the motor and the like are performed at substantially the same time in the locked state, the door is switched to the unlocked state when the outside handle is returned to the normal position. It is not required to unlock the door again and thus the bother of operation of the outside handle can be prevented. Further, the decrease of the bother of operation is obtained by providing the spring 31 at the open link 30, which achieves a simple structure of the door lock device.

Figure 9:
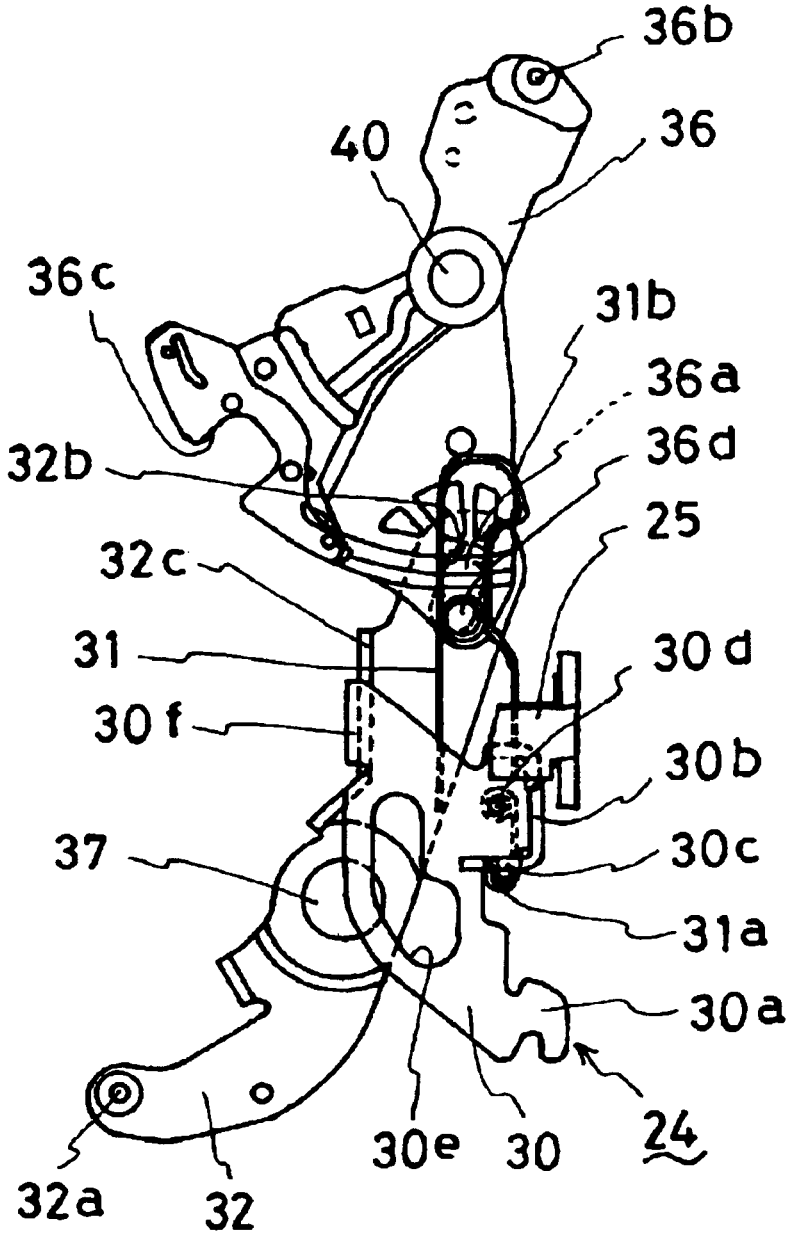
FIG. 9 is a plane view showing a state in which an inside handle is operated in the locked state of the door lock device according to the first embodiment of the present invention.

An operation performed when the inside handle is operated from the locked state in FIG. 6 is explained in the following. In case that the inside handle is operated, the operation force thereof is input to the flange 30*c* of the open link 30 via the first and the second inside open levers 22, 23. The open member 24 as a whole is then moved in substantially upward direction in FIG. 6. At the same time, the second inside open lever 23 is operated with the cancel lever 26 as described above. Then, the rotation force from the cancel lever 26 is applied to the open link 30 via the boss 26*c* formed at the cancel lever 26 and the hole 30*e*, thereby rotating the open link 30 in the clockwise direction in FIG. 6 with respect to the connecting portion 30*a*. Further, in this case, the inside locking lever 32 rotates in the clockwise direction in FIG. 6 with a predetermined amount with respect to the pin 37 due to the engagement between the flange 30*f* of the open link 30 and the bending flange 32*c*. The active lever 36 rotates in the counterclockwise direction in FIG. 6 with respect to the shaft 40 via the connecting elongated hole 32*b* and the connecting pin 36*a*. Then, as shown in FIG. 9, the flange 30*b* of the open link 30 becomes engageable with the lift lever 25 in the upward direction in FIG. 9 and thus the lift lever 25 can be moved as shown in FIG. 5. The pawl 12 and the latch 11 can be moved (i.e. become unlatched state) accordingly. The door lock device 10 is constituted so that the door can be opened without performing the unlocked operation when the inside handle is operated once in the locked state (i.e. one motion operation is possible). When the one motion operation is performed, the operation force of the open link 30 is transmitted to the active lever 36 via the inside locking lever 32 having a rigidity, thereby transmitting the operation force more reliably compared to a case where the spring 31 is used for the transmission.

As explained above, the open member is moved to the unlocked position due to the operation of the cancel lever.

The acting portion of the open member engages with the lift lever in one direction and thus the lift lever is operated. Then, the latch mechanism is operated so that the vehicle door can be opened relative to the vehicle body. In this case, the operation force of the link member of the open member is transmitted to the lock lever via the transmission member. As a result, the lock lever is also moved to the unlocked position.

Figure 10:
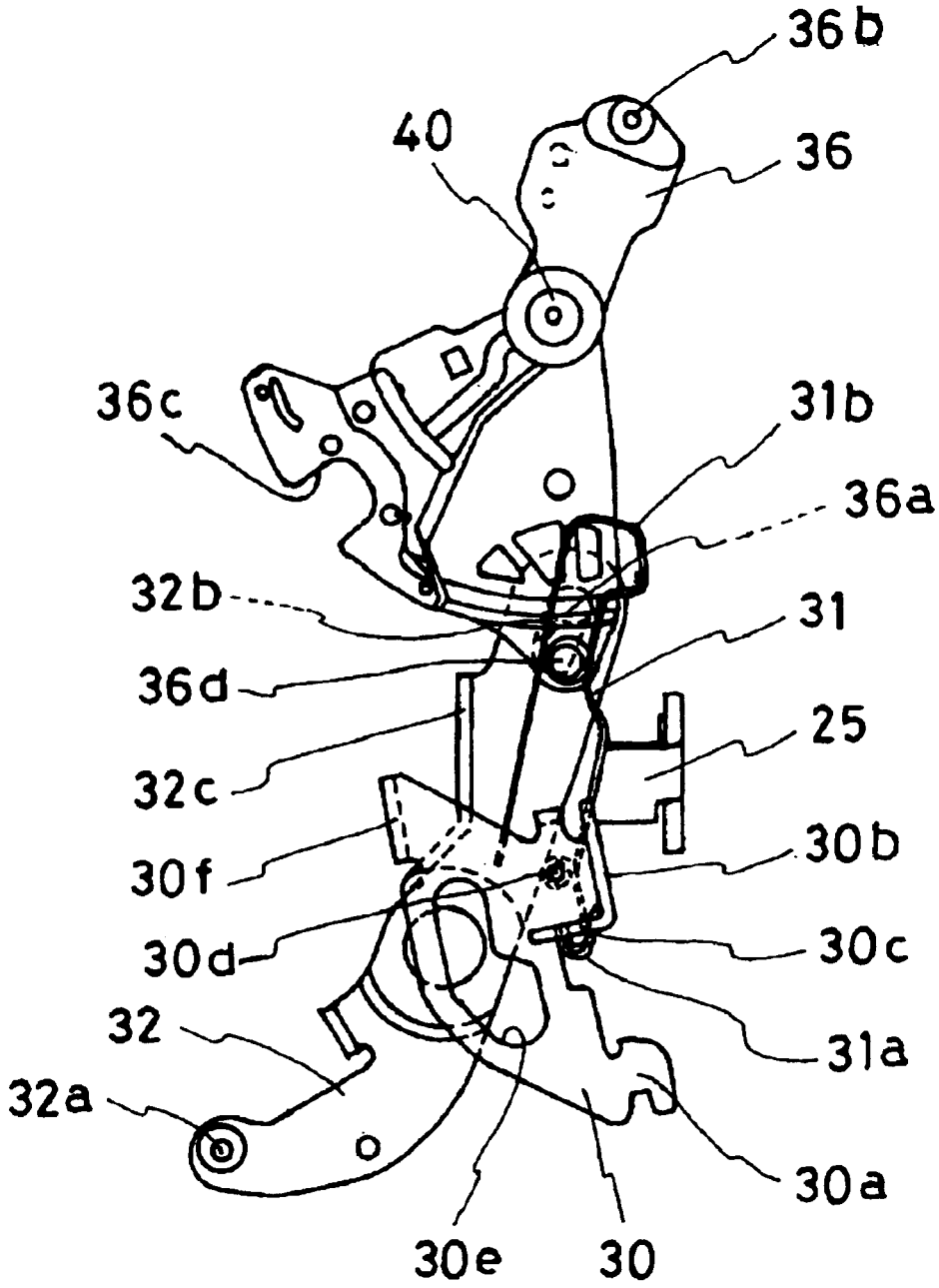
FIG. 10 is a plane view showing a state in which the inside handle is operated in the locked state of the door lock device according to a second embodiment of the present invention.
Figure 11:
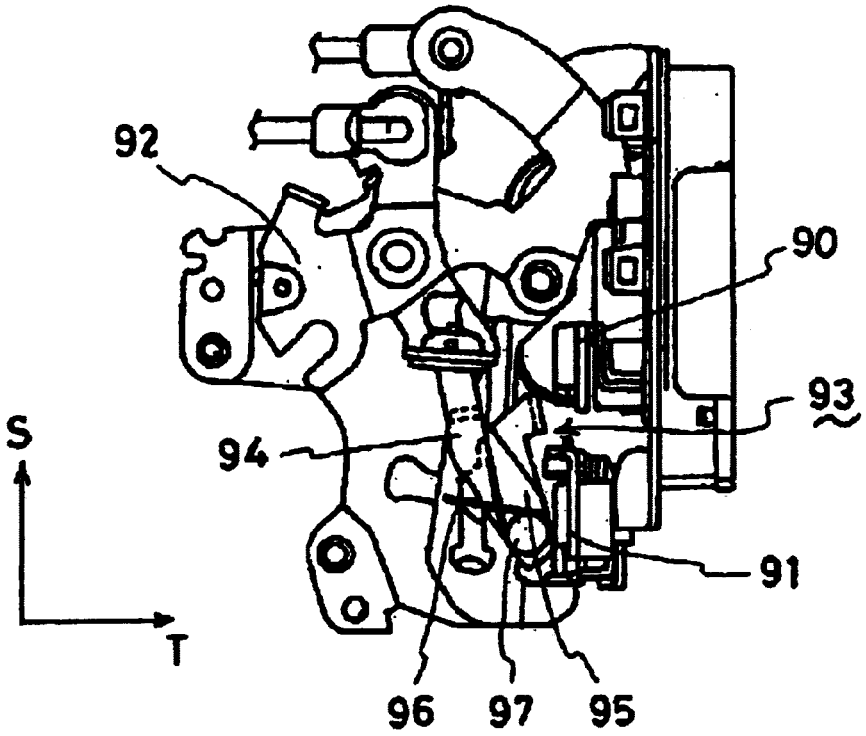
Fig. 11 PRIOR ART
FIG. 11 is a plane view of a known door lock device.

A second embodiment of the present invention is explained referring to FIG. 10. In the second embodiment, a length of the flange 30*b* in up and down direction in FIG. 10 is set longer than that of the first embodiment. The rest structure of the second embodiment is same as that of the first embodiment. According to the second embodiment, when the inside handle is operated one time from the locked state, the door lock device 10 is brought to a state shown in FIG. 10 in the same way as the first embodiment due to the operation force of the second inside open lever 23 and the cancel lever 26. The flange 30*b* of the open link 30 engages with the lift lever 25 in the rightward direction in FIG. 10 (other direction). In this case, the lift lever 25 is not moved and thus the pawl 12 and the latch 11 cannot be operated by one operation of the inside handle. However, the active lever 36 can be moved to the unlocked position since the spring 31 is flexibly moved with respect to the vicinity of the engaging pin 30*d*. When the inside handle is returned to the normal position, the engagement between the flange 30*b* and the lift lever 25 is released and then the unlocked state is obtained as shown in FIG. 4. When the inside handle is operated again, the door can be opened. As mentioned above, when the inside handle is operated twice in the locked state, the door can be opened without performing the unlocked operation (two-motion operation is possible) according to the second embodiment of the door lock device 10. According to the first and second embodiments, the door lock device 10 can easily achieve both one motion operation and two-motion operation only by changing the length of the flange 30*b*.

As explained above, the open member is moved to the unlocked position by the operation of the cancel lever. First, the acting portion of the link member engages with the lift lever in the other direction. At this time, the lift lever is not operated, while the operation force of the link member of the open member is transmitted to the lock lever via the transmission member. The lock lever is then moved to the unlocked position. The lock lever can be moved to the unlocked position since the elastic member is flexibly moved. That is, the lock lever can be moved to the unlocked position regardless of the engagement between the acting portion of the link member and the lift lever. Thus, when the first operation of the inside handle is completed, the engagement between the link member and the lift lever is released and the elastic member is returned due to the biasing force thereof. The open member as a whole is therefore moved to the unlocked position. The door lock device is switched from the locked state to the unlocked state. When the second operation of the inside handle is conducted, the open member engages with the lift lever in one direction, thereby moving the lift lever. The latch mechanism can be operated and thus the vehicle door can be opened relative to the vehicle body.

According to the embodiments of the present invention, even when the door open member and the locking/unlocking member are operated at substantially the same time, a panic state is not caused and the vehicle door is switched to the unlocked state. It is not required to operate the locking/unlocking member again, which prevents the bother of operation. In addition, only by providing the link member and the elastic member as the open member, the bother of operation is prevented.

The vehicle door can be opened relative to the vehicle body by operating the inside handle once or twice in the locked state, which depends on the structure of the acting portion of the link member. Briefly, number of operations of the inside handle required to open the door from the locked state can be determined by changing the structure of the acting portion of the link member.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A door lock device comprising:

a latch mechanism provided at a vehicle door and engageable with or disengageable from a striker provided at a vehicle body;

a lift lever for operating the latch mechanism from an engaged state in which the latch mechanism engages with the striker to a disengaged state in which the latch mechanism disengages from the striker;

an open lever operated by an operation of a door opening mechanism provided at the vehicle door;

a lock lever movable between an unlocked position and a locked position by an operation of a door locking/unlocking member provided at the vehicle door;

an open member operated with the lock lever and movable between an unlocked position and a locked position; the open member including a link member having an operation input portion receiving an operation force from the open lever and an acting portion engageable with the lift lever, and an elastic member connecting the link member and the lock lever;

wherein when the open member is in the unlocked position, the open member engages with the lift lever by an operation of the open lever in one direction thereby allowing an operation of the lift lever, and when the open member is in the locked position, the open member idly engages with the lift lever by the operation of the open lever and then automatically engages with the lift lever in the other direction by a biasing force of the elastic member to prohibit the operation of the lift lever when the open member is switched to the unlocked position from the locker position.

2. A door lock device according to claim 1, further comprising:

the door opening mechanism including an inside handle provided at an inner side of the vehicle door;

a cancel lever operated together with the open lever to shift the open member to the unlocked position when the inside handle is operated under the open member being in the locked position;

the acting portion engaging with the lift lever in the one direction; and a transmission member for transmitting an operation force of the link member to the lock lever.

3. A door lock device according to claim 1, further comprising:

the door opening mechanism including an inside handle provided at an inner side of the vehicle door;

a cancel lever operated together with the open lever to shift the open member to the unlocked position when the inside handle is operated under the open member being in the locked position;

the acting portion engaging with the lift lever in the other direction; and a transmission member for transmitting an operation force of the link member to the lock lever.

4. A door lock device according to claim 2, further comprising a pair of casings, wherein the link member includes an open link arranged between the pair of casings and having a connecting portion, a first flange formed to face to the other one of the pair of casings and extending in a vertical direction of the vehicle, a second flange bent from the first flange so as to be perpendicular thereto, a third flange formed to face to one of the pair of casings, an engaging pin, and a hole connected to a boss formed at the cancel lever.

5. A door lock device according to claim 4, wherein the elastic member includes a spring having one end portion engaging with the open link and an U-shaped portion extending in the vertical direction of the vehicle.

6. A door lock device according to claim 5, wherein the transmission member includes an inside locking lever arranged between the pair of casings and having a connecting hole connected to the door locking/unlocking member provided at the inner side of the vehicle door, a connecting elongated hole connected to a connecting pin formed at the lock lever, and a bending flange extending toward the other one of the casings and engageable with the third flange of the open link.

7. A door lock device according to claim 6, wherein the operation force input portion includes the connecting portion connected to a connecting hole formed at the open lever.

8. A door lock device according to claim 7, wherein the acting portion includes the first flange.

9. A door lock device according to claim 3, further comprising a pair of casings, wherein the link member includes an open link arranged between the pair of casings and having a connecting portion, a first flange formed to face to the other one of the pair of casings and extending in a vertical direction of the vehicle, a second flange bent from the first flange so as to be perpendicular thereto, a third flange formed to face to one of the pair of casings, an engaging pin, and a hole connected to a boss formed at the cancel lever.

10. A door lock device according to claim 9, wherein the elastic member includes a spring having one end portion engaging with the open link and an U-shaped portion extending in the vertical direction of the vehicle.

11. A door lock device according to claim 10, wherein the transmission member includes an inside locking lever arranged between the pair of casings and having a connecting hole connected to the door locking/unlocking member provided at the inner side of the vehicle door, a connecting elongated hole connected to a connecting pin formed at the lock lever, and a bending flange extending toward the other one of the casings and engageable with the third flange of the open link.

12. A door lock device according to claim 11, wherein the operation force input portion includes the connecting portion connected to a connecting hole formed at the open lever.

13. A door lock device according to claim 12, wherein the acting portion includes the first flange.

14. A door lock device according to claim 13, wherein the spring is flexibly moved with respect to a vicinity of the engaging pin of the open link whereby the lock lever is moved to the unlocked position.

* * * * *